United States Patent [19]

Gillette

[11] 4,136,595

[45] Jan. 30, 1979

[54] SINGLE BUS KEYBOARD

[75] Inventor: Timothy C. Gillette, Brookline, Mass.

[73] Assignee: ARP Instruments, Inc., Lexington, Mass.

[21] Appl. No.: 733,772

[22] Filed: Oct. 19, 1976

[51] Int. Cl.[2] ..... G10H 1/00

[52] U.S. Cl. ..... 84/1.01; 84/DIG. 8

[58] Field of Search ..... 84/1.01, 1.03, 1.24, 84/DIG. 8, DIG. 23

[56] References Cited

U.S. PATENT DOCUMENTS

| | | | |
|---|---|---|---|
| 3,511,917 | 5/1970 | Mallett | 84/1.01 |
| 3,627,895 | 12/1971 | Savon | 84/1.01 |
| 3,733,955 | 5/1973 | Reinagel et al. | 84/1.01 |
| 3,828,110 | 8/1974 | Colin | 84/1.01 |
| 3,872,764 | 8/1975 | Munch, Jr. et al. | 84/1.01 |
| 3,930,429 | 1/1976 | Hill | 84/1.01 |
| 4,012,980 | 3/1977 | Suzuki | 84/1.01 |

*Primary Examiner*—Robert K. Schaefer
*Assistant Examiner*—Vit W. Miska
*Attorney, Agent, or Firm*—Cesari and McKenna

[57] ABSTRACT

An inexpensive single bus keyboard circuit for voltage controlled electronic musical instruments. The keyboard signal voltage is sampled and stored after each depression of a key, or release of a key when other keys are held in a depressed state, and a gate detector is provided to prevent sampling and change of stored voltage when all keys are released, to thereby insure that the last stored signal voltage is retained when all keys are released. A program counter establishes the timing relationships between the generated control signals and provides adaptive timing to prevent response to spurious key switch signals. The circuit distinguishes in a simple manner between keyboard sample voltages corresponding to the depression of one or more keys and those corresponding to the condition in which no keys are depressed.

7 Claims, 10 Drawing Figures

SINGLE BUS KEYBOARD

BACKGROUND OF THE INVENTION

A. Field of the Invention

The invention relates to music synthesizers and comprises an inexpensive single bus keyboard for generating control voltages in response to the playing of one or more keys on the keyboard.

B. Prior Art

Electronic music synthesizers commonly make use of keyboards as the control medium for the performer. Control signals are obtained from the keyboard which establish the pitch, intensity, and other characteristics of the signals to be reproduced in response to the depression of one or more keys. One quite useful single bus keyboard is described in U.S. Pat. No. 3,828,110 issued Aug. 6, 1974 to Dennis P. Colin and assigned to the assignee of the present instrument. The present invention is an improvement on the circuitry there described and comprises simple, less expensive circuitry for generating the requisite control signals from the keyboard and which is relatively free from problems associated with key switch "bounce."

BRIEF SUMMARY OF THE INVENTION

A. Objects of the Invention

Accordingly, it is an object of the invention to provide an improved single bus keyboard circuit for a voltage controlled electronic musical instrument.

Further, it is an object of the invention to provide an improved and simplified single bus keyboard circuit which rejects spurious key switch signals such as those resulting from key switch bounce.

Yet another object of the invention is to provide a low cost, single bus keyboard circuit.

B. Brief Description of the Invention

In accordance with the present invention, a keyboard signal source formed from a current source, a resistor string connected in series with the current source, and a plurality of key switches responsive to the depression of one or more keys to "short" or "bypass" one or more resistors in the string, provides an output signal indicative of the keys that are depressed at any moment. In addition to the usual resistor for each key to be played, a further resistor is included in the string to provide a unique output signal when none of the keys are depressed; this output is used to suppress the generation of gating signals during this condition.

The output of the keyboard signal source is supplied to a gating detector which determines whether one or more keys are depressed, and thence to an oscillator, gated by the detector, and operable only when at least one key is depressed. The oscillator in turn controls a program counter which establishes the timing relationships between various control signals derived from the output of the keyboard signal source and thereby determines the time at which a gate output signal is generated. It also establishes the time during which the signal source voltage is sampled to provide a control voltage for use by the note generating circuitry of an electronic music synthesizer.

The output of the keyboard signal source is also applied to a voltage-change detector which provides a characteristic pulse whenever there is a change in condition in the keyboard, that is, on each depression of one or more keys or on the release of all keys. The detector pulse resets the program counter, as well as various latches in the circuitry, to prepare for the generation of a new gating signal as long as one or more keys are depressed.

Contact bounce in the key switches can generate spurious detector pulses which must be distinguished from true pulses denoting the time of change. Heretofore this has been done by delaying generation of the gate signal by a fixed amount after receipt of the first detector pulse in a sequence to allow time for the key switches to "settle" to a rest state; the gate generating circuitry is rendered unresponsive during this time. The delay time must be sufficiently long to lock out the normally encountered contact bounce periods, but short enough so as not to prevent the generation of necessary gate signals in response to the rapid playing of a succession of notes. Wear, dirt, or other aging effects can extend the contact bounce time beyond its original range and the gate generating circuitry may then respond to spurious signals. The present invention avoids this by providing a variable delay that adapts itself to the duration of contact bounce signals of significant amplitude. It does this by resetting the program counter and starting the count anew each time a detector corresponding to either an actual key switch change or a switch bounce signal of sufficient magnitude is generated. The gate output signal is thus not generated until the switch bounce signals have sufficiently diminished in magnitude so that no further detector pulses are generated in response to the change in state of a key. Thus, the circuit accommodates changes in keyboard characteristics without the need of further adjustment.

DETAILED DESCRIPTION OF THE INVENTION

Figure 1:
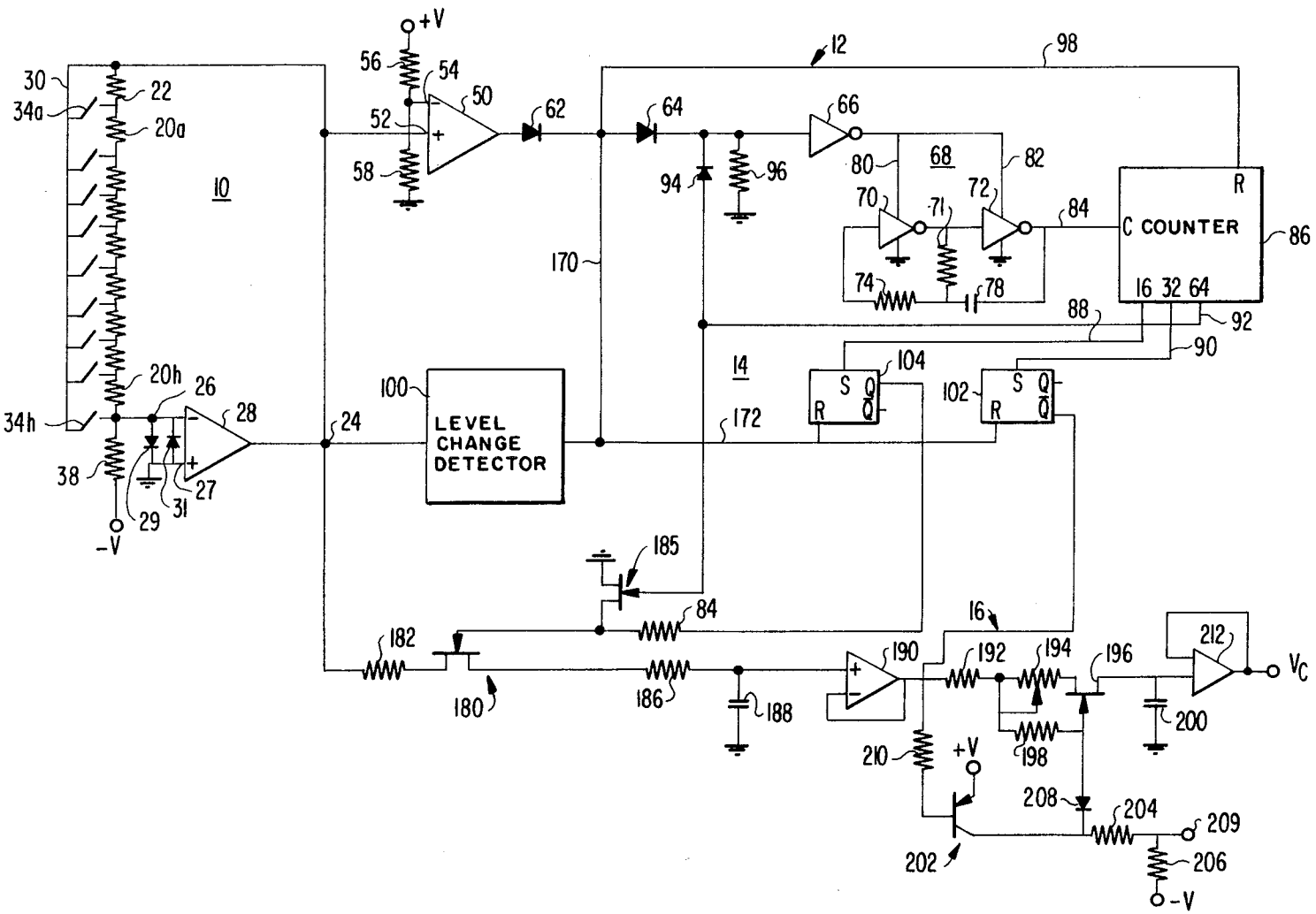
Figure 2A:
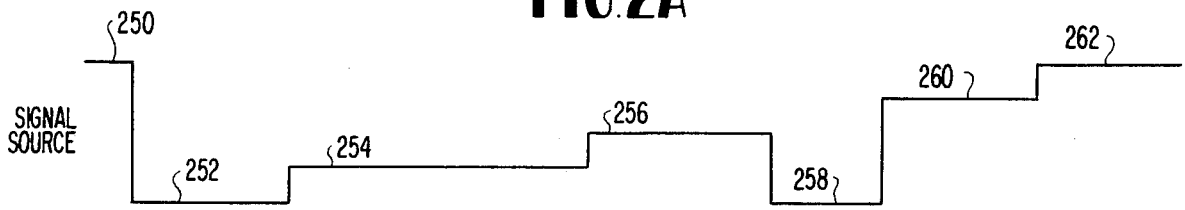
Figure 2B:
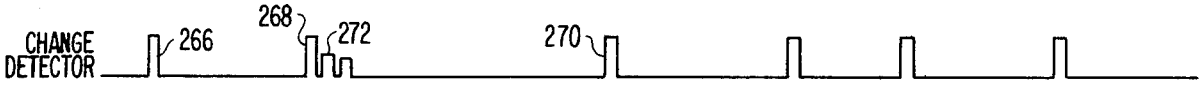
Figure 2C:
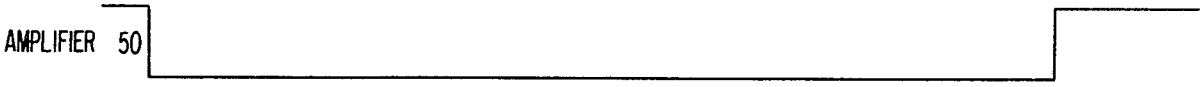
Figure 2D:
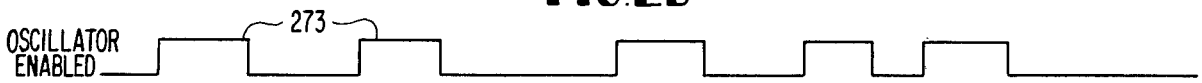
Figure 2E:
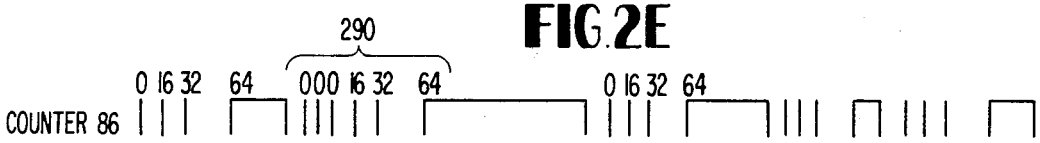
Figure 2F:
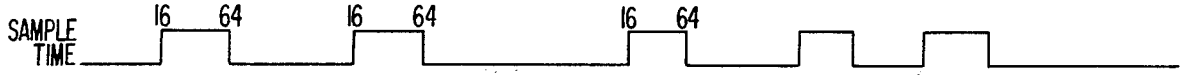
Figure 2G:
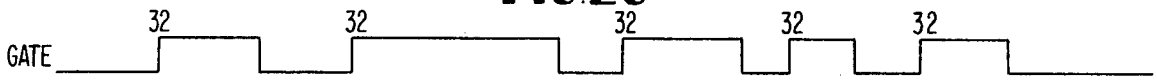
Figure 2H:
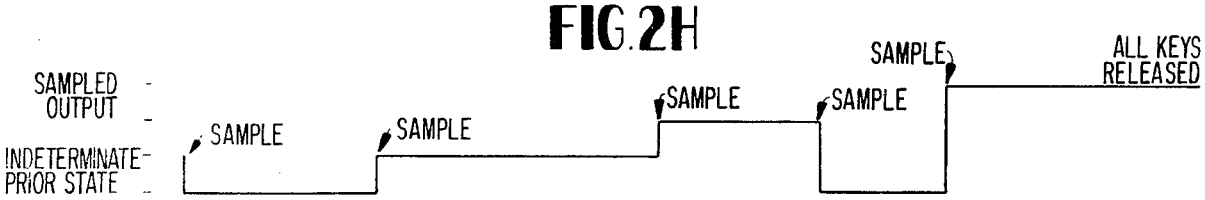
Figure 3:
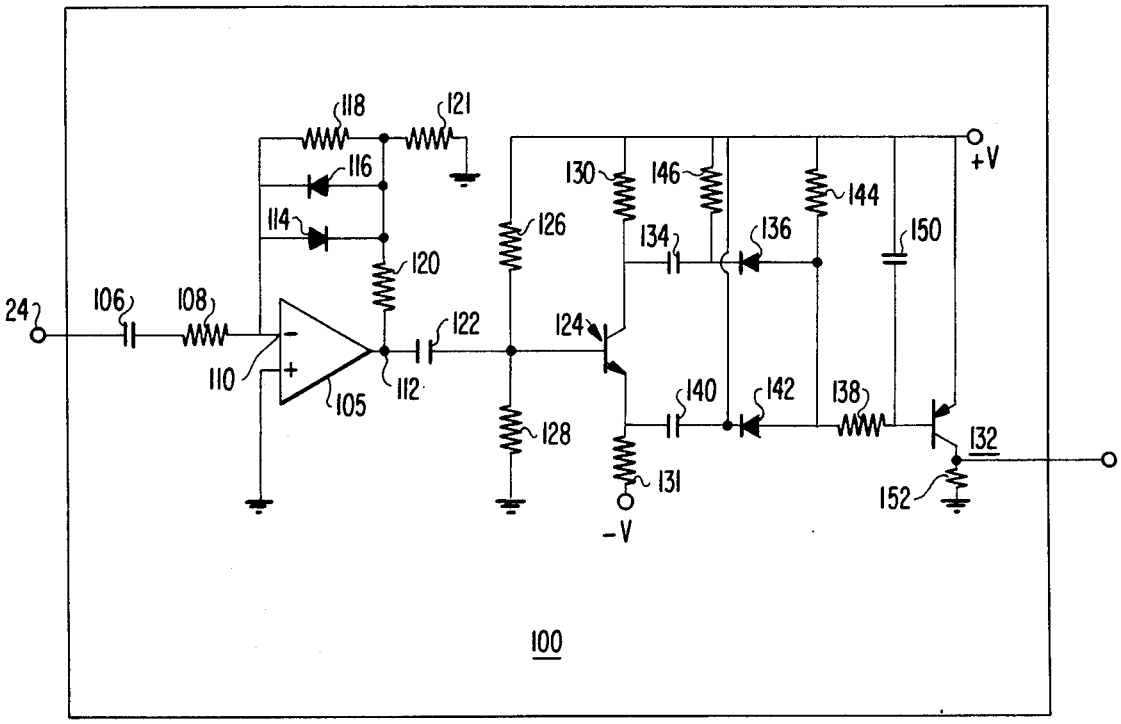

The foregoing, and other and further objects and features of the invention, will be more readily understood from the following detailed description of the invention, when taken in conjunction with the drawings in which:

FIG. 1 is a block and line diagram of a single-bus keyboard in accordance with the present invention, FIGS. 2A–2H show certain of the control signals in accordance with the present invention, FIG. 3 is a block and line diagram of a change-detector circuit used in the present invention.

In FIG. 1, a keyboard signal source 10 generates a control signal indicative of the state (i.e., depressed or not depressed) of keys on a conventional organ-type keyboard and supplies this signal to a timing channel 12, a change detector channel 14, and a control voltage storage channel 16.

The signal source 10 is formed from a series of resistors **20*a*–20*h* and a resistor 22 connected in series between an output terminal 24 and an inverting input terminal 26 of an operational (high gain, high input impedance, low output impedance) amplifier 28; the non-inverting input terminal 27 is connected to ground. Diodes 29 and 31 are connected across the input terminals to limit the voltage across the input. A bus bar 30 is also connected to the amplifier output terminal 24, and a series of single-pole switches 32*a*–32*h* are connected between the bus bar and respective junction points of the resistors 20 and 22**.

The switches are connected to a keyboard, such as an organ type keyboard (not shown), there being one switch for each key on the board. Switch **34*h* corresponds to the lowest note, while switch 34***a* corresponds to the highest note. Intermediate switches correspond to intermediate notes. When a key is depressed ("played") it closes a corresponding one of the switches 34 to thereby short out one or more of the resistors 20, 22 and thus modify the effective resistance connected between the amplifier terminals 24 and 26. A fixed amount of current is drawn from the terminal 26 by a source of negative potential-V in series with a resistor 38; a corresponding and equal current is injected into the terminal 26 from the amplifier output through those ones of the resistors 20, 22 which are not shorted by one of the switches 34. The magnitude of the voltage at the output terminal 24 is thus the product of the fixed current V/R38 and the unshorted resistance between the terminals 24 and 26, and corresponds to the level associated with the lowest note played at any given time. Advantageously, the resistors 20, 22 are of low resistance (e.g., 100 ohms each) and the current is of the order of a milliampere.

The output of amplifier 28 is applied to the timing channel 12 comprising a high gain comparator amplifier 50 having a non-inverting input terminal 52 connected to receive the output of amplifier 28 directly and an inverting input terminal 54 connected to the mid-point of a pair of resistors 56, 58 which are connected in series with each other and with a potential source +V. A gating signal that is high when no note is being played but is low otherwise is obtained at the output of amplifier 50 by proportioning the resistors 56 and 58 and the source +V to hold the inverting input terminal 54 at a potential that is greater than the output of amplifier 28 when the highest switch 34*a* (corresponding to the highest note of the keyboard octave) is closed, but lower than the output of amplifier 28 when one of the switches 34 are closed. This gating signal is applied through isolating diodes 62, 64 and inverter 66 to an oscillator 68 formed from inverters 70, 72, resistors 74, 76, and capacitor 78. The supply voltages for the inverters are obtained from the inverter 66 via leads 80, 82, respectively. The inverters 66, 70 and 72 may be obtained in a single integrated circuit, type CD4007 AE.

The output of the oscillator 68 is connected via a lead 84 to the clock (count) input terminal of a program counter 86. Counter 86 is a multi-stage counter providing output signals on leads 88, 90, 92, respectively, when certain counts are reached. For present purposes, these counts may be considered to be counts of 16, 32, and 64 on the leads 88, 90, and 92, respectively. Lead 92 is connected back to the input of inverter 66 through a diode 94. A resistor 96 is also connected between the input of inverter 66 and ground. The counter is reset on receipt of a signal via a lead 98. In the preferred embodiment, the counter 86 is a type CD 4024 AE integrated circuit.

The output of the keyboard signal source 10 is also applied to change detection channel 14 comprising a voltage change detector 100 and flip flops (latches) 102, 104. Detector 100 preferably is as shown in FIG. 6 of the Colin patent, U.S. Pat. No. 3,828,110 referred to previously, and will be described only briefly here as shown in FIG. 3.

Basically, it is formed from an operational amplifier 105 to which an input signal is supplied through a DC blocking capacitor 106 and a resistor 108. Extending between an inverting input terminal 110 and an output terminal 112 of the amplifier 105 are a pair of diodes 114, 116 and a resistor 118, all connected in parallel with each other and in series with a further resistor 120. A resistor 121 is connected between ground potential and a common point of the diodes 114, 116 and resistors 118 and 120.

A further DC blocking capacitor 122 connects the output of amplifier 105 to the base terminal of a transistor 124. The operating point of transistor 124 is set by means of biasing resistors 126, 128 which extends between a source of positive potential +V and ground, the mid point of these resistors being connected to the base of transistor 124. A resistor 130 is connected between the positive potential source and the collector of transistor 124, and a resistor 131 is connected between a negative potential source −V and the emitter of this transistor. Output pulses from the collector of transistor 124 are coupled to the base of a transistor 132 via a DC blocking capacitor 134, a diode 136, and a resistor 138. Similarly, output pulses from the emitter of transistor 124 are coupled through a DC blocking capacitor 140, a diode 142 and resistor 138 to the base of transistor 132. Diode 136 is normally reverse biased by resistors 144 and 146; similarly, diode 142 is normally reversed biased by resistors 144 and 148. A capacitor 150 is connected between the positive potential source and the base of transistor 132, while a resistor 152 is connected between the collector of transistor 132 and ground potential.

FIG. 2E shows the counting sequence corresponding to the signals shown in FIGS. 2A through 2D. The counter 86 counts as long as oscillator 68 is on. Although the counter steps through each counting state from 0 through 64, only the counting states of 0, 16, 32, and 64 are shown as significant.

Considering now the sequence of counting signals corresponding to the level 252 (FIG. 2A), latch 104 is set from counter 86 when the latter reaches a count of 16. At this time, the Q output of the latch goes high; this energizes the gate of transistor 180 to complete the circuit between the capacitor 188 and the output of signal source 10. Capacitor 188 then charges through resistors 186 and 182 to a voltage which is proportional to the instantaneous output of the source 10. During this time, the transistor 202 is held non-conducting by latch 102 and the gate of transistor switch 196 is held at a negative voltage from source −V via resistors 204 and 206 and diode 208. Accordingly, switch 196 is open.

The next event of significance is the energization of the gate of transistor 196 when the counter reaches a count of 32. At this time, the Q output of latch 102 goes high and the $\overline{Q}$ output goes low to unblock the transistor 202. The collector of this transistor thereupon goes high and a gate output appears at the gate output terminal 209. At the same time, diode 208 becomes reverse biased and transistor switch 196 is closed to charge the capacitor 200.

The next significant event occurs when the count 86 reaches a count of 64. At this time, oscillator 68 is turned off from the counter via lead 92 and diode 94. Further, the gate of transistor 185 is energized and this turns the transistor on, thereby connecting the gate of transistor 180 to ground and turning the transistor off; the sampling now ceases, as shown in FIG. 2F. However, the gate output (FIG. 2G) continues until the appearance of the next detector pulse from the change detector 100, at which time the gate output is also terminated; at this time, switch 196 opens.

Consider now the sequence of events which occurs when one or more spurious detector pulses, such as the pulses 272, occur. As long as a pulse is of sufficient magnitude to forward bias the diode 64, it turns off the oscillator 68 for the duration of the pulse and additionally resets the program counter 86. Thus, the counter is continuously reset to its initial count of zero with each spurious pulse, and never reaches the first significant count (16); thus, no sample is taken, nor is a gate voltage generated. However, after receipt of the last spurious pulse of sufficient amplitude to forward bias the diode 64, the counter 86 is allowed to continue its count as shown at 290 in FIG. 2E, and the sample is thereupon taken and the output gate pulse generated in the manner previously described. Thus, the present circuit readily adapts itself to the deterioration of one or more key switches and inhibits the generation of sampled output signals and gate outputs as long as spurious detector pulses occur. Once these pulses die out, the outputs are generated as desired.

FIG. 2H shows the sampled output voltage. It will be seen from this that the sampled output remains at the last level corresponding to a true key depression, and does not change in response to spurious key switch signals or to changes in level caused by return to state in which no keys are depressed.

From the foregoing, it will be seen that I have provided an improved keyboard circuit. The circuit provides voltage sample outputs, and control (gate) outputs only in response to actual changes in the condition of one or more keys on a keyboard and ignores spurious signals caused by key switch bounce. Further, it repeatedly samples the keyboard voltage in response to each change in condition there, but provides gate (control) outputs and sampled voltage outputs only when one or more keys are depressed, even though the keyboard is an active source which provides a voltage output even when no keys are depressed. The circuit is inexpensive to implement and reliable in operation. Accordingly, it constitutes a marked improvement over musical instrument control circuits previously unavailable.

Having illustrated and described my invention, I claim:

1. A control circuit for electronic musical instruments, comprising

A. means responsive to the playing of one or more notes on a musical instrument to generate signal levels indicative of each note, as well as at least one non-zero signal level indicative of the playing of no notes, B. level change detection means responsive to said level generating means and providing an output in response to changes in said levels, C. gating means responsive to said level generating means to provide a gating signal indicative of the playing of no note, and D. means responsive to both said level change detection means and said gating means for generating a control signal only when at least one note is played and maintaining said control signal when all keys are released.

2. The circuit of claim 1 in which said signal level generating means comprises (1) means forming a current source, (2) a plurality of impedances fed by said current source, there being at least one impedance for each note to be played, and (3) a plurality of switches, one for each note to be played, connected to short out corresponding ones of said impedances when said notes are played.

3. The circuit of claim 2 in which said current source includes an amplifier having a high input impedance, low output impedance, and high gain, and in which said impedances are connected in series with each other and in inverse feedback relation around said amplifier.

4. The circuit of claim 2 in which said gating means comprises a comparator amplifier which changes its output from one state to another in response to a change in the output of the level generating means to a level corresponding to the playing of no note.

5. A control circuit for electronic musical instruments, comprising

A. means responsive to the playing of one or more notes on a musical instrument to generate signal levels indicative of each note, as well as at least one non-zero signal level indicative of the playing of no notes, B. level change detection means responsive to said level generating means and providing an output in response to changes in said levels C. gating means responsive to said level generating means to provide a gating signal indicative of the playing of no note, and D. means responsive to both said level change detection means and said gating means for generating a control signal only when at least one note is played and maintaining said control signal when all keys are released, said means including counting means responsive to each output of said level change detection means as long as said gating signal is not provided by said gating means to thereby provide timing signals for controlling the time at which the outputs of said control signal generating means appear.

6. The circuit of claim 5 in which said control signal generating means further includes oscillator means connected to energize said counting means and thereby drive said counting means through its successive counting states, said oscillator being energized on the absence of said gating signal.

7. The circuit of claim 6 in which the output of said level change detection means is applied to reset said counting means to zero count and in which said timing signals are provided only after said counter reaches at least a preselected count above zero whereby no control output is generated whenever said level change detection means provides outputs separated in time by an amount less than the time corresponding to said preselected count.

* * * * *